United States Patent [19]

Best et al.

[11] 4,318,558

[45] Mar. 9, 1982

[54] LATCH BOLT MECHANISM

[75] Inventors: Walter E. Best; William R. Foshee, both of Indianapolis, Ind.

[73] Assignee: Best Lock Corporation, Indianapolis, Ind.

[21] Appl. No.: 146,670

[22] Filed: May 5, 1980

[51] Int. Cl.[3] ..... E05C 1/16

[52] U.S. Cl. ..... 292/173; 292/169.13

[58] Field of Search ..... 292/173, 169.13; 70/151 R, 151 A

[56] References Cited

U.S. PATENT DOCUMENTS

| | | | |
|---|---|---|---|
| 1,876,081 | 9/1932 | Schlage . | |
| 2,930,646 | 3/1960 | Ahlquist et al. | 292/163 |
| 2,958,553 | 11/1960 | Phillips | 292/169.13 X |
| 3,112,944 | 12/1963 | Adler | 292/169.13 |
| 3,353,858 | 11/1967 | Neary et al. | 292/169.13 X |
| 3,876,236 | 4/1975 | Best et al. | 292/169.13 |

*Primary Examiner*—Richard E. Moore

*Attorney, Agent, or Firm*—Jenkins, Coffey, Hyland, Badger & Conard

[57] ABSTRACT

A deadlocking latch bolt in a tubular housing is connected to a tailpiece front cross head having a retainer arm in a radial window in the bolt and a blocker arm abutting the opposite housing side to maintain the connection. A deadlocking tumbler is biased to bolt deadlocking position. An auxiliary bolt, when projected, holds the tumbler in release position, and when retracted relative to the bolt, allows the tumbler to take deadlocking position. A channel-shaped tailpiece cam member engaged for linear movement with the cross head has a cam face presented to move the tumbler to release position when the deadlocked bolt is drawn rearward by the tailpiece. The bolt is movable relative to the tailpiece when thrust rearward so as to be deadlocked against the tumbler before actuating the tailpiece and its cam member, but has no lost motion when pulled rearward by the tailpiece. A rear guide block in the housing forms a guideway with a side entrance for admitting a narrow tailpiece portion thereto, and is self-sustained on the tailpiece when moved rearward against a tailpiece stop. Bolt springs and the tumbler are assembled between the guide block and the bolts on the tailpiece to form a self-sustained subassembly slidably insertable in the housing.

27 Claims, 11 Drawing Figures

FIG. 1
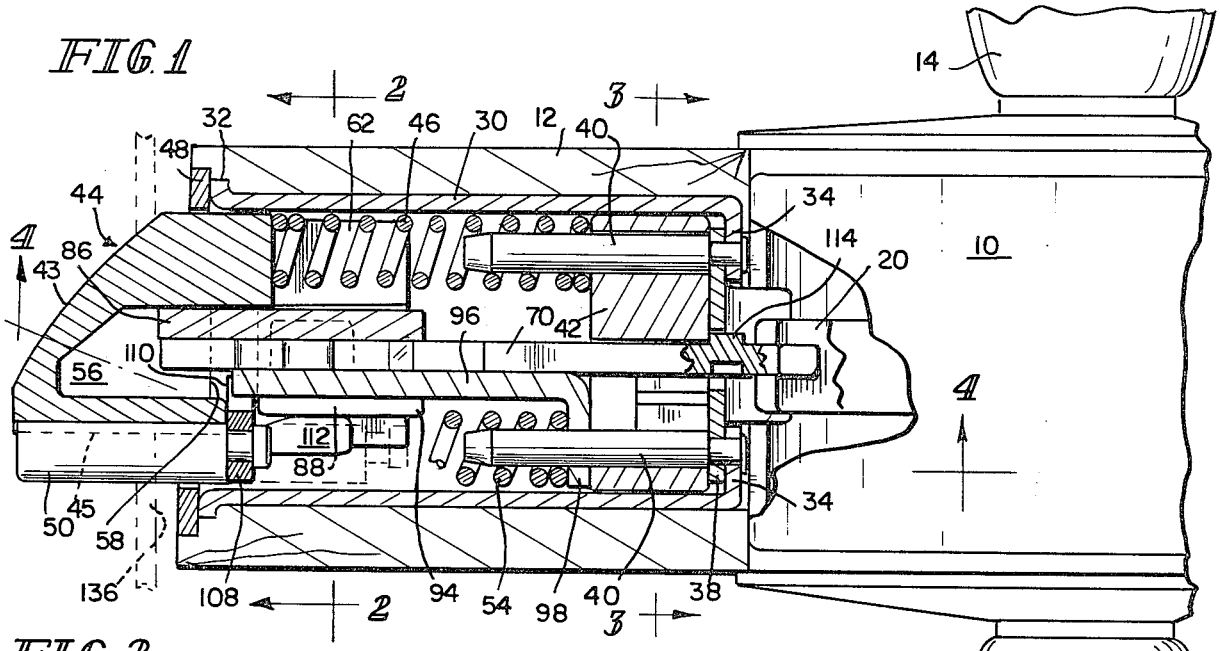
FIG. 2
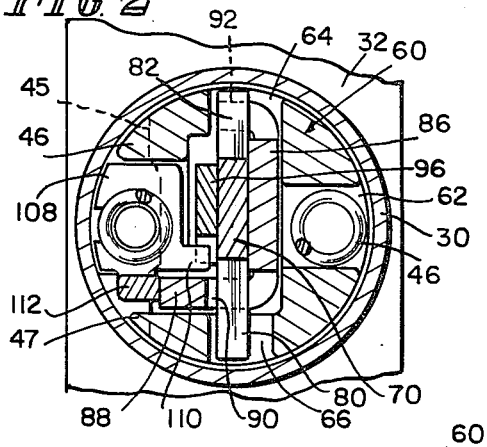
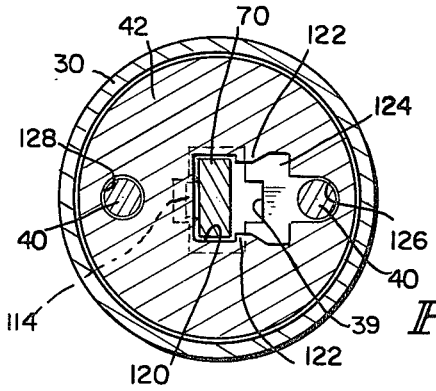
FIG. 3
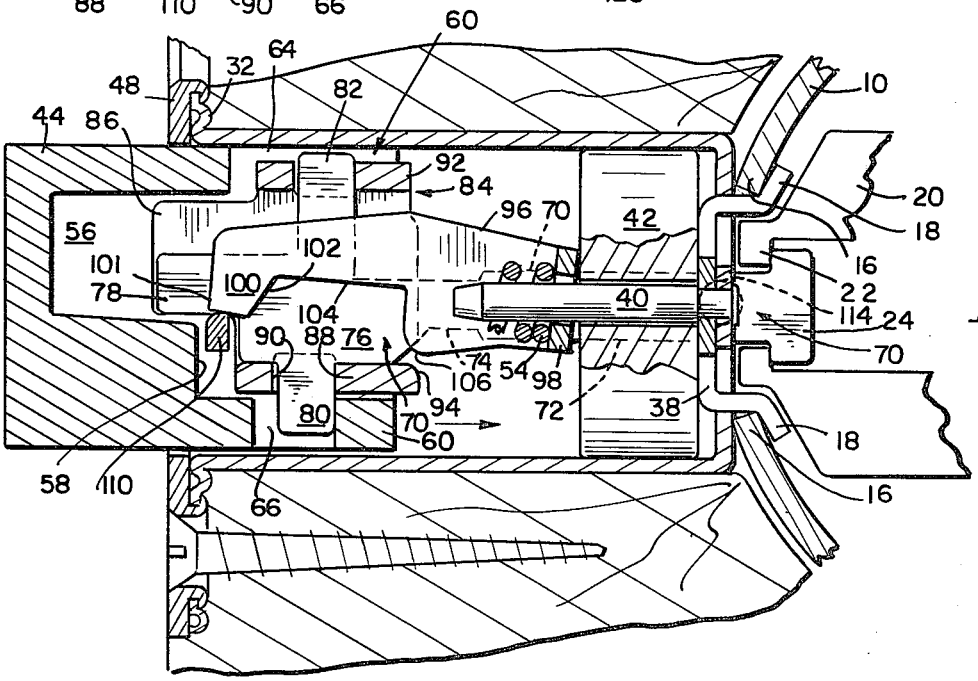
FIG. 4

FIG. 6
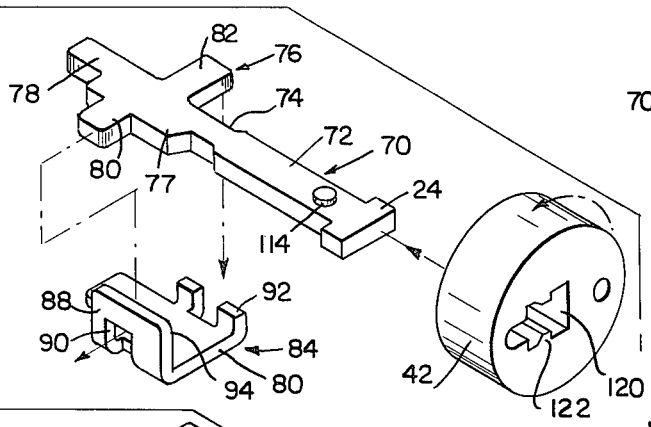
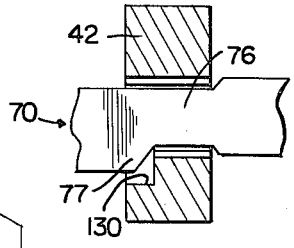
FIG. 8
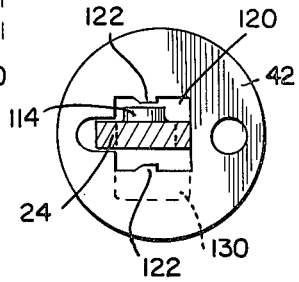
FIG. 7
FIG. 9
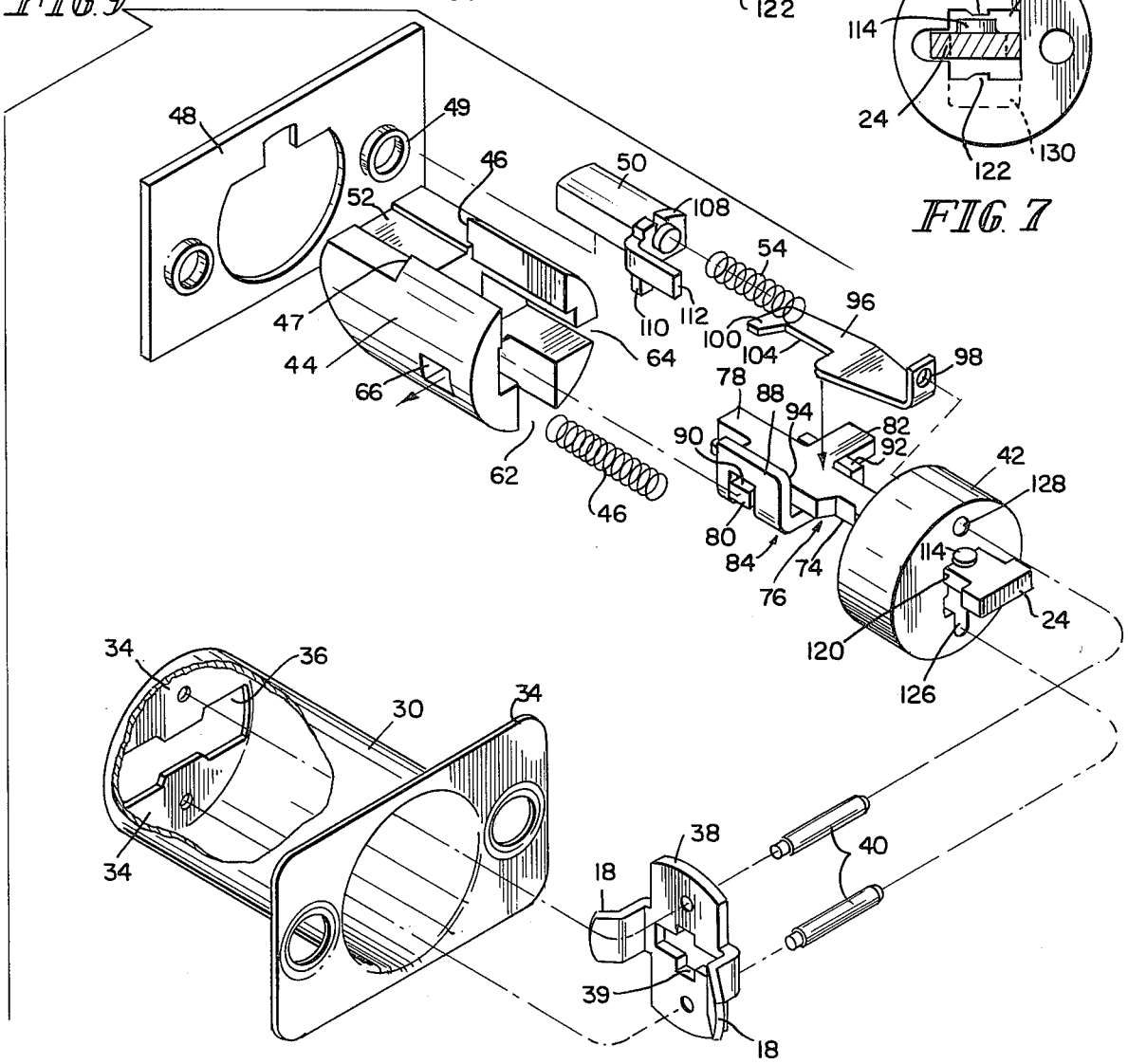

LATCH BOLT MECHANISM

This invention relates to latch bolt mechanism and especially deadlocking latch bolt mechanism useful both in cylinder locks and tubular locks.

In certain prior latch tube mechanisms, such as that shown in Walter E. Best and R. Gene McCullum U.S. Pat. No. 3,876,236 of Apr. 8, 1975, and in the prior Schlage U.S. Pat. No. 1,876,081 of Sept. 6, 1932, retraction of the latch bolt by the tailpiece required a considerable amount of initial lost motion of the tailpiece to release the deadlocking tumbler, which in turn required a relatively long throw of the retractor and in consequence a relatively larger cylindrical chassis. In certain other deadlocking latch bolt mechanisms, such as that sold under the trademark ARROW, operation of the latch bolt by the tailpiece required no lost motion therebetween, and the deadlocking tumbler mechanism was relatively simple and reliable, but the lock used a relatively short throw retractor and used a so-called "multiplier" to amplify the bolt throw relative to the retractor throw, and further, used an offset tailpiece, so that operation of the bolt by the tailpiece was not direct. Also, the mechanism was difficult to assemble, and required a secondary operation during assembly to provide a forwardly presented stop for the tailpiece.

The importance of such tailpiece stop can be appreciated from consideration of the timing relationship used. The latch bolt is spring-pressed forward against a stop on the face plate of the latch tube assembly. A limited amount of lost motion is provided between the latch bolt and the deadlocking tumbler, and camming means is provided between the tailpiece and the deadlocking tumbler which is effective to move the tumbler to a release position during initial retraction movement of the bolt by the tailpiece through a distance less than that lost motion distance. Accordingly, it is also necessary to provide a lost motion connection between the tailpiece and the bolt so that when the bolt is thrust rearward as in an attempted forced entry, the bolt will move in lost motion relative to the tailpiece and engage the deadlocking tumbler and become deadlocked before such bolt movement causes movement of the tailpiece sufficient to actuate such camming means and move the deadlocking tumber to its release position. Such bolt-/tailpiece lost motion should occur only when the bolt is thrust rearward and not when it is drawn rearward by the tailpiece, and it is necessary to stop the tailpiece at a point which takes up the lost motion between such tailpiece and the bolt so as to properly position the rear cross bar of the tailpiece for engagement with the retractor in assembly of the latch bolt mechanism with an associated cylinder or tubular lock mechanism in a door.

In accordance with the present invention, the tailpiece is a straight member, with a coplanar cross head and without an offset, and is directly connected to the bolt by a retraction arm of its cross head, and the tumbler release cam face for the tailpiece is provided by a separate tailpiece cam member. Desirably, the tailpiece cross head has both a retraction arm engaged in a window in a rearward skirt portion of the bolt and also a retainer arm which extends into blocked relation with the tubular housing to prevent disengagment of the retraction arm from the skirt, and the tailpiece cam member is desirably engaged with both such arms so as to be guided for rectilinear movement with the tailpiece and to assist in guiding such tailpiece in such rectilinear movement in the latch tube.

Further in accordance with the invention, latch bolt mechanism includes a latch bolt slidable in a tubular housing having an open end, a tailpiece that extends axially of the housing for retracting the bolt, the bolt being adapted to be assembled to the forward end of the tailpiece in self-sustaining and aligned forward-stopped position, a reaction member which also preferably forms a tailpiece guideway, which member is slidably receivable in the tubular housing through its open end, and means for mounting such member on a rearward portion of the tailpiece in a self-sustaining and aligned rearward-stopped position, so that such bolt and reaction member are adapted to be assembled on the tailpiece together with spring means stressed between them, and with other parts such as a deadlocking tumbler and its controls, to form a self-sustaining assembly adapted to be slidably inserted as such in the open end of the housing, and secured therein between forward stop means for the bolt and rearward support means for the reaction member.

In the preferred form of the invention, the tailpiece in its original manufacture is provided with a stop for limiting its forward movement and is guided at the rear of the latch tube by a guide block. The tailpiece has a parallel-sided rear portion adapted to be guided in the block and has a narrowed portion forward thereof, and the guide block defines both a guideway for the parallel-sided rear portion, and an entranceway to that guideway adapted to pass the narrowed portion of the tailpiece. The tailpiece can be moved into alignment with the guideway by passing its narrowed portion through the entrance, and can then be moved longitudinally to bring its parallel-sided portion into the guideway. In the case of a latch for a cylindrical lock, where the tailpiece has a short cross bar at its rear end, the stop provided on the tailpiece may be a boss projecting from one face of the tailpiece, such as is produced by punching a half perforation in the tailpiece, and in such case, the guide block may be a cylindrical member provided with an opening which defines the guideway at the center and is sufficiently enlarged laterally thereof to pass the rear cross bar of the tailpiece and the projecting stop boss. The tailpiece can then be passed through such opening to bring its narrowed portion into the opening, and then moved laterally and rotated to bring its parallel-sided portion into alignment with the guideway. In the case of a latch bolt for a tubular lock, the tailpiece may have a wide rear portion which defines forwardly presented shoulders adapted to engage the rear face of the guide block, and in such case, the guide block may be of C-shaped cross section with the guideway defined behind the in-turned ends of the C-shape and the entrance defined by the space between such ends.

A latch tube mechanism in accordance with the invention may be assembled conveniently, as follows. The tailpiece is assembled to the guide block as described above, so that its parallel-sided portion immediately ahead of the stop is engaged in the guideway of the guide block. The tailpiece cam member is then assembled to the cross head of the tailpiece, and this front assembly is inserted in the rear cavity of the latch bolt, with the cross head moved laterally to engage the retraction arm thereof in the retraction window of the bolt. The tailpiece will then longitudinally interconnect the guide block with the latch bolt and the parts will be held in sufficiently stable alignment to permit insertion of a latch bolt biasing spring between the guide block and bolt along one face of the tailpiece, and to insert a deadlocking tumbler and an auxiliary bolt and an intervening spring along the other side of the tailpiece. This will produce a substantially self-sustaining assembly of the parts which are to be inserted in the tubular housing, so that the assembly can be inserted in a tubular housing by moving it axially into the housing. A face plate is then secured to the front flange of the housing, and this completes the assembly.

The invention provides a deadlocking latch mechanism which has a desirable timing sequence similar to that described above, which provides a long bolt throw fully corresponding to the retractor throw so as to provide high security, which embodies a simple and reliable deadlocking tumbler arrangement similar to that which has been used and found effective in the prior ARROW lock, and in which the tailpiece is a straight member directly connected to the bolt, which provides long bolt throw without the use of a multiplier, and which in general is adapted to operate reliably and easily over a long-life period. In addition, the mechanism is composed of relatively simple sturdy elements in an interrelationship which facilitates their assembly with each other and in the tubular housing and without intervening forming steps.

The accompanying drawings illustrate the invention and show preferred embodiments of it for a cylindrical lock and for a tubular lock, exemplifying the best mode of carrying out the invention as presently contemplated. In such drawings:

FIG. 1 is a horizontal section of a cylindrical lock including a latch tube mechanism in accordance with the invention;

FIG. 2 is a vertical section taken on the line 2—2 of FIG. 1;

FIG. 3 is a vertical section on the line 3—3 of FIG. 1;

FIG. 4 is a vertical section on the line 4—4 of FIG. 1, showing the latch bolt in its normal projected position and the deadlocking tumbler in its non-deadlocking position;

FIG. 6 is a diagrammatic view showing the assembly of the tailpiece with its guide block and with the tailpiece cam member;

FIG. 7 is an end elevation of the guide block shown in FIG. 6 and showing the relation of the tailpiece cross bar to the opening therein as the cross bar end of the tailpiece is passed through the guide block during assembly;

FIG. 8 is a longitudinal section showing the relative positions of the guide block and the narrowed portion of the tailpiece in a position for movement of the tailpiece into alignment with the guideway in the guide block;

FIG. 9 is an exploded view showing the assembly of the latch tube mechanism;

Figure 5:
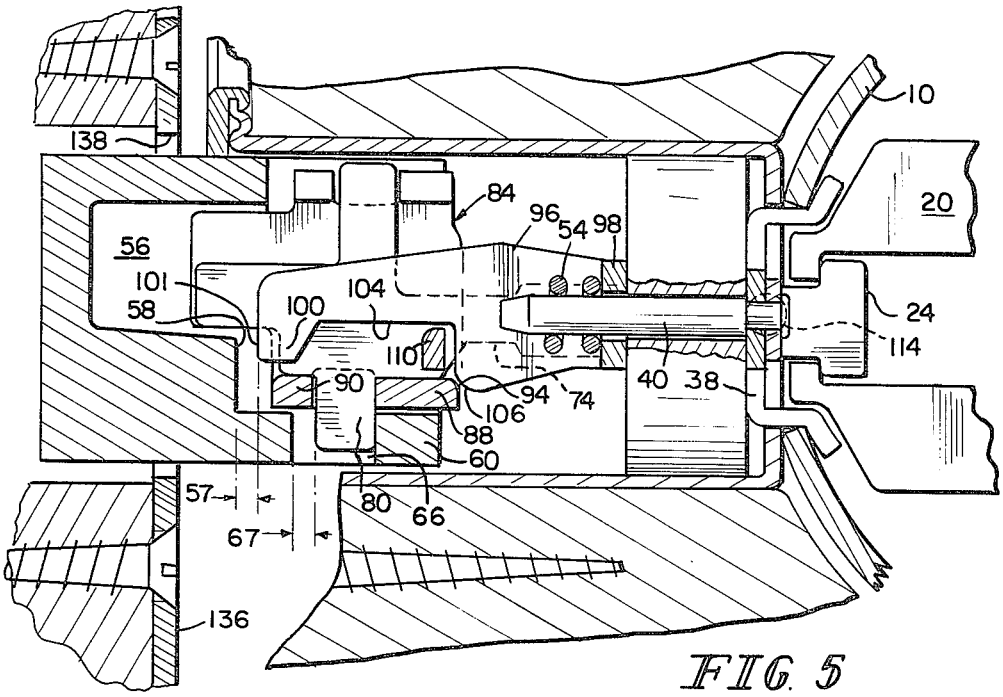
FIG. 5 is a section similar to FIG. 4, but showing the deadlocking tumbler in its deadlocking position.

The cylinder lock shown in FIGS. 1 and 4 comprises a cylinder lock chassis 10 mounted in a cross bore in a door 12 and provided with two opposite knobs 14. As is conventional, the cylindrical housing of the chassis 10 is formed with an axial slot which is defined by edges 16 which engage prongs 18 at the rear of the latch tube assembly described below. The housing contains a bolt retractor 20 operated by the knobs 14 and including forward jaws 22 which engage a cross bar 24 at the rear of the tailpiece of the latch tube assembly for retracting that tailpiece and the bolt. As shown in FIG. 5, the bolt is adapted to engage a strike 136 mounted in the doorjamb as shown in FIG. 5.

The latch tube assembly comprises a tubular housing 30 formed with an out-turned rectangular flange 32 at its forward end and having rear wall segments 34 which define a generally rectangular diametric opening 36 shown in FIG. 9. A back plate 38 is seated against the end wall segments 34 and carries the prongs 18 which engage the chassis housing. The back plate is riveted to the segments 34 by rivets integral with spring guide pins 40. A guide block 42 is mounted over those pins and against the back plate 38.

A latch bolt 44 is slidably mounted in the front end of the latch tube 30, is spring-pressed forward by a spring 46, and is stopped in projected position by engagement of stop shoulders 46 and 47 with a face plate 48. The face plate is fixed to the front flange 32 by integral hollow rivets formed about the mounting screw holes as shown in FIG. 4. The bolt 44 has a bevelled front face 43 and a generally flat rear face 45. An auxiliary bolt 50 is mounted against that face 45 and seated in a shallow longitudinal groove 52 therein, so as to be guided for relative longitudinal motion. The auxiliary bolt 50 is biased forward by a spring 54 diametrically opposite from the bolt-biasing spring 46.

The latch bolt 44 is formed with a central cavity 56 of generally rectangular cross section which at one side is bordered by an abutment face 58. The bolt 44 has a rearward extending skirt portion 60 of generally circular cross-section but with a number of interruptions. These include a side slot 62 forming a pocket seat for the spring 46, and an edge slot 64 and opposite window 66 for the reception of tailpiece mechanism described below.

The bolt 44 is connected to the retractor 20 of the cylinder lock by a tailpiece 70 which lies flat in the central vertical plane of the latch tube as shown in FIG. 1. As shown in FIGS. 4 and 6, the tailpiece 70 includes the rear cross bar 24, a straight-sided guidable portion 72 extending forward therefrom, a narrowed waist portion 74 which connects to a cross head portion 76. The cross head portion has a forward end 78 which extends into the cavity 56 of the bolt 44 and has a bolt-retracting arm 80 for engagement in the window 66 of the bolt, and a blocker arm 82 which extends oppositely into blocking relation with the side wall of the latch tube to prevent disengagement of the cross head from the bolt skirt.

The cross head 76 of the tailpiece is engaged in a cam member 84 in the form of a shallow channel having a bottom wall 86 which lies flat against the back face of the cross head and has a forward nose extending into guided relationship with the cavity 56 in the bolt 44. The wall 86 is connected at one side to an upstanding side wall 88 containing a window 90 which closely receives the retraction arm 80 of the cross head. An opposite shorter side wall 92 defines a slot which closely receives the blocker arm 82 of the cross head. The rear edge of the side wall 88 defines a cam face 94 for actuating the deadlocking tumbler as described below. When the cam member 84 is in place as shown in FIG. 4, its engagement with the arms 80 and 82 hold it in substantial alignment with the tailpiece and it assists in guiding the forward end of the tailpiece for linear axial movement with, and in support of, the latch bolt 44.

A deadlocking tumbler 96 is mounted with its forward leg against the front face of the tailpiece 70, by means of an out-turned foot 98 received over a spring guide pin 40 and spring-pressed against the front face of the guide block 42 by the biasing spring 54 which biases the auxiliary bolt 50 to projected position. Such deadlocking tumbler 96 has a forward blocker nose 100 defined by a front blocker face 101 and a rear cam face 102. Behind the cam face 102, the tumbler is shaped with a wide undercut relief 104, and behind that with a cam nose 106 adapted to be engaged by the cam face 94 on the cam member 84. The deadlocking tumbler 96 is so oriented with respect to its foot 98 that the spring 54 biases the tumbler to its deadlocking position shown in FIG. 5, in which the foot 98 lies flat against the front face of the guide block 42 and the blocker nose 100 lies in spaced blocking relation with the blocker face 58 on the latch bolt 44. Under these conditions, also, the cam face 94 of the tailpiece cam member lies closely opposite the cam nose 106 of the deadlocking tumbler so as to cam it to a release position when the tailpiece is retracted by the retractor 20. As will be seen in FIG. 5, there is a small clearance 57 of predetermined amount between the blocker face 58 of the latch bolt and the blocker face 101 of the deadlocking tumbler 96, and there is a corresponding clearance 67 between the front face of the window 66 and the retractor arm 80. These clearances permit rearward lost motion of the bolt relative to the tailpiece sufficient to carry the bolt 44 into deadlocked position against the blocker nose 100 of the tumbler 96 before the front face of the window 66 engages the retractor arm 80 sufficiently to move the tailpiece and the cam face 94 against the tumbler-releasing cam nose 106.

For purposes of normally holding the deadlocking tumbler 96 in its release position, as shown in FIG. 4, a release cam 108 is fixed to the rear end of the auxiliary bolt 50 by an integral rivet. The release cam normally lies against a rear face on the latch bolt 44 to stop relative forward movement of the auxiliary bolt 50, and includes a cam finger 110 which projects into the plane of the deadlocking tumbler 96, as shown in FIGS. 1, 2, and 4. It also includes a guide arm 112 extending rearward and adapted to ride on the longitudinal edge face of the side wall 88 of the tailpiece cam member 84. As shown in FIGS. 1 and 4, when the auxiliary bolt is in its normal advanced position, the cam finger 110 of the release cam 108 lies against the front side edge of the deadlocking tumbler 96, and holds that tumbler in a cocked position in which its blocker nose 100 lies opposite the cavity 56 in the latch bolt 44. Accordingly, if the door is closed and the strike causes the latch bolt 44 to be cammed rearward with the parts in this relationship, the bolt will not be deadlocked, but can move freely rearward past the blocker nose 100 of the deadlocking tumbler 96. When the door reaches closed position as shown in FIG. 5, the strike will hold the auxiliary bolt 50 in a retracted position as shown in dotted lines in FIG. 1, and this will cause the release finger 110 to be moved to the rear of the undercut relief 104 and away from the blocker nose 100, so as to allow the deadlocking tumbler to move to its deadlocking position as shown in FIG. 5. Under these conditions, rearward thrust on the latch bolt 44, as in an attempted forced entry, will carry the blocker face 58 of that bolt against the blocker face 101 of the deadlocking tumbler 96, and the bolt will be deadlocked against further retraction.

In such forced-entry movement of the latch bolt 44, it first moves through a small amount of lost motion to take up the predetermined small clearances 57 and 67 provided between the blocker faces 58 and 101 and between the front face of the window 66 and the retraction arm 80 of the cross head of the tailpiece. On the other hand, there is no lost motion when the latch bolt 44 is retracted by rearward pull on the tailpiece, since the tailpiece is normally held in the position shown, where the retraction arm 80 of the tailpiece cross head lies against the rear face of the window 66 of the latch bolt 44 so that any rearward movement of such retraction arm will immediately produce rearward movement of the latch bolt. For purposes of maintaining this relationship with the tailpiece at the rearward limit of the lost motion between it and the bolt, the tailpiece 70 is provided with a stop which stops its forward motion relative to the fully projected position of the latch bolt 44, where the bolt is stopped by engagement of its shoulders 46, 47 against the face plate 48. Such stop is in the form of a boss 114 conveniently formed by stamping a half perforation in the tailpiece 70 immediately behind the rear face of the guide block 42, as shown in FIGS. 1, 4, and 9. It will be seen in FIG. 9 that the opening in the back plate 38 has a main portion adapted to pass the tailpiece and has side notches 39 to clear the boss 114 for engagement against the rear face of the guide block 42.

In certain prior deadlocking latch bolt mechanisms of this general type, for example, in the ARROW mechanism, it is necessary to form a stop in the tailpiece after that tailpiece has been preassembled with other parts in the latch tube, and this adds to manufacturing costs both because it requires a forming operation during assembly and because it interrupts and complicates the assembly process. The present invention allows the stop boss 114 to be made in the original manufacture of the tailpiece 70 and avoids the need for a forming step during the assembly. This result is obtained by the use of the guide block 42 and of its interrelation with the tailpiece and other parts both in operation and during assembly. As noted above, the guide block 42 provides a stop face for the tailpiece stop 114 and its front face supports the latchbolt biasing spring 46 and the foot 98 of the deadlocking tumbler. For guiding and assembly purposes, the guide block 42 is formed with an opening of special configuration. As seen in FIG. 3, that opening includes a rectangular guideway 120 at the center of the circular guide block 42 for guiding the straight-sided portion 72 of the tailpiece. This is defined on three sides by flat surfaces. At the fourth side, the guideway is defined by a pair of opposite ribs 122 which define between them an entranceway for purposes which will appear. Beyond such entranceway between the ribs 122, the opening includes a wider portion 124, and beyond that a semicircular portion 126 which receives one of the spring guide pins 40. At a diametrically opposite point, the guide block 42 is formed with a bore 128 to receive the other spring guide pin.

As shown in FIG. 7, the depth of the guide block opening, in a direction normal to the guideway 120, is sufficient to pass the cross bar 24 at the rear of the tailpiece when such bar is oriented in a pass-through position, and is wide enough to pass the stop boss 114. Accordingly, assembly of the tailpiece 70 with the guide block 42 may be done as a preliminary step, as follows and as indicated in FIG. 6. The guide block 42, in the orientation shown in FIGS. 6 and 7, is assembled over the cross bar end of the tailpiece 70, and is moved along the tailpiece until the guide block comes into registry with the narrowed waist portion 74 of the tailpiece, as shown in FIG. 8. As here shown, the front face of the guide block is formed with a pocket 130, which reduces the length of the guide block opening sufficiently to permit the full width lengths of the cross head center bar and the guidable portion 72 of the tailpiece to approach each other more closely than would otherwise be the case. Thus, the cross head has a rear corner 77 which enters the pocket 130 when the guide block 42 is in proper alignment with the narrow waist portion 74. In that alignment, that waist portion is sufficiently narrow to permit the guide block to be rotated in the direction of the arrown shown in FIG. 6 and otherwise moved to carry the narrow waist portion through the entranceway defined between the two side ribs 122 of the guide block opening, and thus to carry the tailpiece and its guidable portion 72 into proper orientation and axial alignment with the guideway 120. The guide block is then slidably moved rearward along the tailpiece 70 against the stop 114 with the guidable portion 72 in guided relation with that guideway.

After this preassembly of the guide block 42 on the tailpiece 70, further assembly can proceed as follows and as indicated in FIGS. 6 and 9. The next step is the assembly of the tailpiece cam member 84 to the cross head 76. To this end, the retractor arm 80 of the cross head 76. To this end, the retractor arm 80 of the cross head is inserted through the window 90 of the cam member, and the blocker arm 82 then moved downward into the notch in the opposite side wall 92 of the cam member, so as to form a subassembly as shown at the right in FIG. 9. This subassembly, with the cross head moved over against the side wall 92 so as to retract the retraction arm 80 into the window 90, is then inserted into the rear skirt portion 60 of the latch bolt 44. When the retraction arm 80 comes into alignment with the window 66 in that skirt portion, the cross head is then moved to the left to engage the retraction arm 80 in that window 66. Concurrently, this draws the blocker arm 82 of the cross head inward of the circumference of that skirt portion so that the skirt portion can later be inserted in the latch tube 30, where the wall of that latch tube will lie in blocking relation with the end of the blocker arm 82 as shown in FIG. 4 so as to prevent disengagement of the retraction arm 80 from the window 66. The latch bolt 44 and the guide block 42 will now be held in spaced relation and in substantial axial alignment, by engagement of the tailpiece both with the latch bolt and that guide block. Assembly then proceeds by mounting the bolt-biasing spring 46 between the bolt 44 and the guide block and by mounting the deadlocking tumbler 96, the auxiliary bolt 50 with its release cam 108, and the biasing spring 54 in proper relation between the latch bolt and guide block. This forms a substantially self-sustaining subassembly which can then be inserted endwise into the preassembled latch tube 30.

The latch tube 30 will have been preassembled by mounting the back plate 38 against the rear wall segments 34 by means of the rivets at the rear ends of the spring guide pins 40, so that the spring guide pins 40 will stand in proper position within the guide tube 30 to enter the openings 126 and 128 as the latch bolt subassembly is inserted. As the final assembly proceeds, the guide pins 40 will pass through those openings, and into guiding position as shown in FIGS. 1 and 4 in relation to the foot 98 of the deadlocking tumbler 96 and the two biasing springs. With the latch bolt assembly in place in the latch tube 30, a face plate 48 is mounted against the front flange 34 of the latch tube, and the rivets 49 are entered through the corresponding openings in the flange 34 and riveted over to secure the face plate 48 in place against the front flange 34 of the latch tube.

Operation of the deadlocking latch bolt mechanism described above is as follows. The normal condition of the parts with the door open and with both the latch bolt 44 and auxiliary bolt 50 in projected position is as shown in full lines in FIGS. 1–4. The latch bolt 44 is stopped in its fully projected position by engagement of its shoulders 46 and 47 against the back surface of the face plate 48, while the tailpiece is stopped in its forwardmost position by engagement of its stop boss 114 against the rear face of the guide block 42. The relationship of the stops is such that, as shown in FIG. 4, the retraction arm 80 of the cross head of the tailpiece 70 is at the rearward limit of its small lost motion relative to the latch bolt and bears against the rear face of the window 66 in the skirt 60 of the latch bolt. The auxiliary bolt 50 is projected to its forwardmost position where it is stopped by engagement of its release cam 108 with a rear face on the latch bolt, and where its cam finger 110 in the position shown in FIG. 4 underlies the blocker nose 100 of the deadlocking tumbler 96 to hold that tumbler in cocked position and aligned with the cavity 56 in the latch bolt.

If the door is now closed against a strike 136, the cam face 43 of the latch bolt 44 engages the strike and the latch bolt 44 is cammed rearward in the latch tube and relative to the cocked deadlocking tumbler 96. In such movement, the latch bolt first moves relative to the tailpiece cross head to take up the small amount of lost motion therebetween, and carries the front face of the window 66 of the latch bolt skirt 60 against the forward edge of the retraction arm 80 of the cross head, and thereafter, the tailpiece is thrust rearward with the latch bolt 44. Such rearward movement carries a side wall of the bolt cavity 56 past the blocker nose 100 of the deadlocking tumbler to inactivate that tumbler, and the release ram 108 moves rearward with the bolts and away from that nose. There is a one-way connection between the tailpiece cross bar 24 and the retractor 20, and the tailpiece telescopes into the retractor.

When the door reaches fully closed position and the latch bolt 44 comes into alignment with the opening 138 of the strike 136, the latch bolt 44 is projected by its biasing spring 46 to projected position, while the auxiliary bolt 50 is held in retracted position by the strike 36, as indicated in dotted lines in FIG. 1. This positions the cam finger 110 in the position shown in FIG. 5, where it lies in the undercut relief 104 in the deadlocking tumbler 96 and allows the tumbler to take its normal, uncocked position as shown in FIG. 5 under the influence of the biasing spring 54. This brings the blocker face 101 of the deadlocking tumbler 96 into blocking relation with the blocker face 58 on the latch bolt 44. Accordingly, rearward movement of the latch bolt 44, as by reason of an attempted forced entry, will carry the latch bolt blocking face 58 against the blocking face 101 of the deadlocking tumbler 96, and the latch bolt will be deadlocked against further retraction movement by this engagement.

Retraction of the latch bolt by the knob and cylinder lock mechanism will be permitted, as follows. As noted above, the latch bolt 44, in its normal fully projected position, either when the door is open or when the door is closed in FIG. 5, will be at the forward limit of its small lost motion relative to the tailpiece, and the tailpiece 80 will lie against the rear face of the window 66 in the skirt 60 of the latch bolt. When the cylinder lock mechanism is actuated by one of the knobs 14 or by an associated key cylinder, the retractor 20 will pull the tailpiece 70 by its cross bar 24 rearward, and the resulting retraction motion will be immediately transmitted by the retractor arm 80 to the skirt 60 of the latch bolt so that latch bolt retraction movement will occur immediately and concurrently with the retraction of the tailpiece. The full stroke of the retractor 20 will thus be transmitted, without lost motion, from the tailpiece 70 to the latch bolt 44 so as to produce a full retraction stroke of the latch bolt equivalent to the retraction stroke of the retractor 20.

In such knob-actuated retraction of the bolt, the deadlocking tumbler will be inactivated and will not block bolt retraction. As the retraction arm 80 of the cross head moves the latch bolt rearward, it also carries the tailpiece cam member 84 rearward, by reason of the engagement of the retractor arm 80 in the window 90 of that cam member. The initial movement of the side wall 88 of that tailpiece cam member carries its cam face 94 into engagement with the cam nose 106 on the deadlocking tumbler 96 so that further movement will cam that tumbler to its cocked position and carry its blocking nose 100 clockwise from its deadlocking position shown in FIG. 5 to its release position shown in FIG. 4, where its blocker nose 100 is aligned with the cavity 56 of the latch bolt 44. Such cocking of the deadlocking tumbler 96 occurs before sufficient bolt movement has occurred to carry the blocker face 58 of the latch bolt 44 through the clearance 57 and into engagement with the blocker face 101 of the deadlocking tumbler 96. Accordingly, the deadlocking tumbler 96 will not block tailpiece retraction of the latch bolt 44.

As the latch bolt 44 reaches fully retracted position as a result of knob operation, it picks up the auxiliary bolt 50 in the relationship shown in FIG. 1, and when the door is opened and the knob released, the latch bolt 44 and the auxiliary bolt 50 are both driven forward by their biasing springs 46 and 54 to their projected positions as shown in FIG. 1. This carries the release finger 110 of the release cam 108 forward toward its position shown in FIG. 4. As it approaches such position, the release finger 110 engages the cam face 102 on the back side of the blocker nose 100 and rides under that nose as it leaves the cavity 56 of the bolt 44. In the event the auxiliary bolt 50 is projected after the latch bolt has reached projected position, the tumbler nose moves out of the cavity before it is engaged by the release finger, such finger will lift the deadlocking tumbler 96 to its cocked position. The parts are then back in their normal, open-door positions as shown in FIGS. 1–4.

Figure 10:
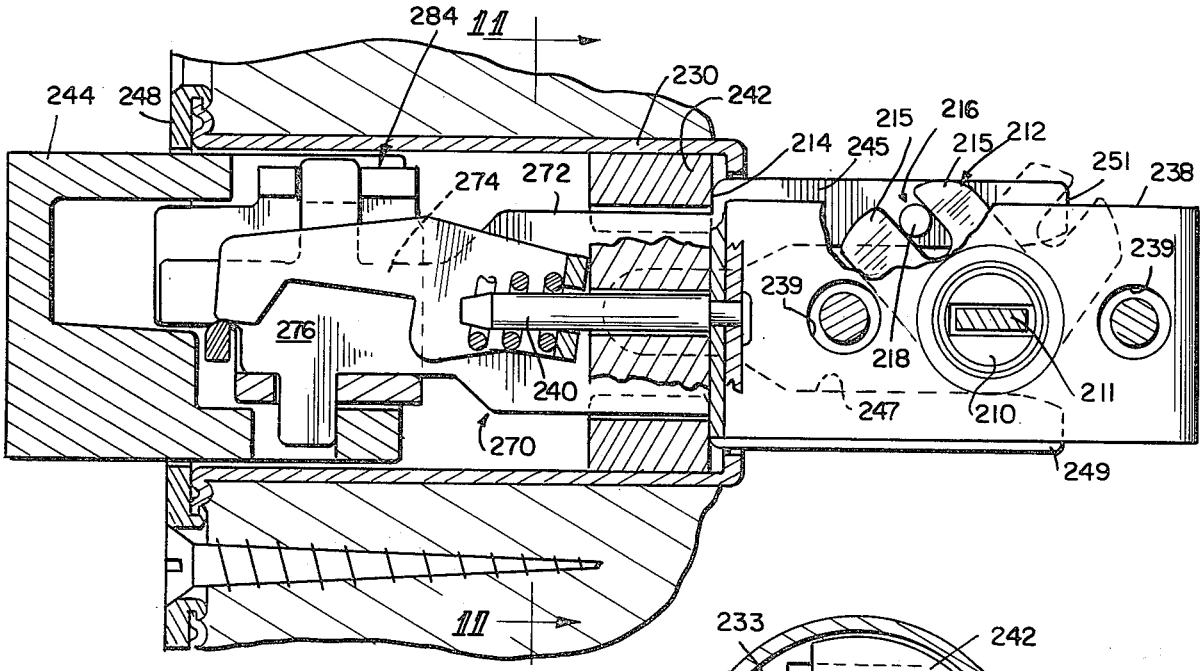
FIG. 10 is a sectional view similar to FIGS. 4 and 5 but showing a latch tube assembly for a tubular lock.
Figure 11:
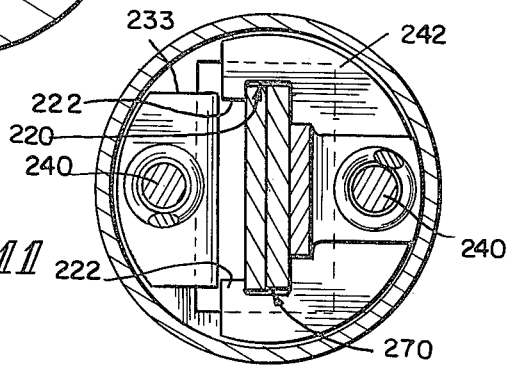
FIG. 11 is a section on the line 11—11 of FIG. 10.

In the modification shown in FIGS. 10 and 11, the latch tube 230, the latch bolt 244 and its associated auxiliary bolt, the tailpiece cross head 276 and the tailpiece cam member 284 are identical with the corresponding parts of the modification of FIGS. 1–9. The guide block 242 and the rearward portions of the tailpiece 270 are different, and are more fully shown in our co-pending application Ser. No. 146,791, filed May 5, 1980. The latch tube 230, instead of having a back plate 38 with ears for engagement in the housing of a cylindrical lock, is provided with a rearward extension 238 which rotatably supports the hub 210 of a rotary retractor 212 which carries a pair of radial arms 215 defining between them a radial slot 216. The rearward extension has out-turned tabs 237 at its front end which are secured to rear wall segments of the latch tube 230 by rivets integral with spring guide pins 240. Such extension contains two openings 218 to pass fastening bolts for the door-mounted operating mechanism of a tubular lock. The tailpiece 270, instead of being in the form of a narrow bar, has a substantially widened, straight-sided portion 272 adapted to be guided by the guide block 242, and behind that guide block 242 has a still wider rear portion 245 which defines forward stop shoulders 214. Such rear portion contains a central slot 247 so that it take the form of a yoke having two side bars 249 and 251, and these straddle and embrace a central cylindrical portion of the hub 210 of the retractor 212. The upper side bar 216 carries a cross pin 218 engaged in the slot 216 of the retractor. The hub 210 of the retractor has rectangular diametric opening which receives a flat spindle 211 by which the retractor is rotated by the door-mounted tubular lock mechanism to retract the tailpiece 270.

As shown in FIG. 11, the guide block 242 is of C-shaped cross section which defines a guideway 220 of a size and shape to receive and guide the guidable portion 272 of the tailpiece 270. Such guideway 220 is defined on three sides by flat surfaces of the guide block 242 and on the fourth side, shown to the left in FIG. 11, is defined by two inward extending ribs 222 which define between them an entranceway wider than the narrow portion 274 between the cross head 276 and the guidable portion 272 of the tailpiece 270.

The assembly of this modification of FIGS. 10 and 11 is similar to that of the earlier modification. The guide block 242 is preassembled with the tailpiece 270 by passing the narrow portion 274 sideways through the entranceway between the ribs 222 to bring the guidable portion 272 into alignment with the guideway 220. The tailpiece is then moved forward in the guide block 242 until the shoulders 214 at the forward end of the rear yoke portion 245 of the tailpiece engage against the rear face of the guide block 242 to stop the forward motion of the tailpiece. The tailpiece cam member 284, the latch bolt 244, and its auxiliary bolt, and the biasing springs are then assembled as described above in connection with FIG. 9, so as to form a self-sustaining assembly of the latch bolt 244 and guide block 242 on the tailpiece. This assembly is then inserted in the latch tube 230 and the yoke portion 245 of the tailpiece is guided through the opening in the rear wall of the latch tube 230 and between the side walls of the extension, and into straddling and embracing relation with the hub of the retractor 212. As it approaches the hub, the cross pin 218 is entered into the radial slot 216 of the retractor 212. When the parts reach the positions shown in FIG. 10, the face plate 248 is secured to the front flange of the latch tube and this completes the assembly.

In both modifications, the guide block is shaped to receive a tailpiece with a preformed stop element such as the boss 114 in the first modification and the stop shoulders 214 in the second modification. Such guide block serves both as a tailpiece guide and as a reaction member and facilitates assembly by permitting the tailpiece and bolts and their associated parts to be assembled to a self-sustaining assembly before insertion in the latch tube 230. Further, the stop elements can be conveniently and accurately positioned in the original manufacture of the tailpieces so as to produce an accurate timing relation between those stops and the forward stop shoulders of a latch bolt 244, and thus to avoid wasteful lost motion in the retraction of the bolt by the tailpiece, and hence to permit the latch bolt to have a stroke fully equivalent to the retraction stroke of the cylindrical or tubular lock mechanism with which the latch bolt mechanism is used. This is especially advantageous in the tubular lock mechanism of FIGS. 10 and 11, where it permits the axis of the latch bolt mechanism to be coplanar with the axis of the tubular lock and its spindle 11, while also permitting a full long bolt throw within the limits of the somewhat restricted throw of the rotary retractor.

In exemplifying embodiments of the deadlocking latch tube mechanism shown and described, the tailpiece and bolt each had a retraction throw of 9/16 inch (1.429 cm) and the clearances 57 and 67 were about 0.09 inch (2.29 mm). The same parts were used in latch tube assemblies for both the cylindrical lock and tubular lock applications.

We claim:

1. Deadlocking latch bolt mechanism, comprising a tubular housing adapted to be mounted in the edge of a door, a latch bolt slidable in the housing between projected and retracted positions and having a rearward skirt portion defining a radial window and an opposite slot, a deadlocking tumbler movable between deadlocking and release positions, an auxiliary bolt for controlling the position of the deadlocking tumbler, a tailpiece having a rearward portion adapted to be drawn rearward by retraction means, said mechanism also including the improvement comprising a cross head on the tailpiece having a retractor arm engaged in the radial window of the latch bolt for retracting such bolt, a tailpiece cam member slidably mounted in the latch bolt and having a side wall containing a window aligned with said latch bolt window, said cross head retractor arm being engaged in such side wall window so as to move the cam member rearward when the tailpiece is drawn rearward by the retractor means, and cam means acting between the cam member and tumbler for moving the tumbler from deadlocking position to release position in response to such rearward movement of the cam member by such rearward drawn movement of the tailpiece.

2. Deadlocking latch bolt mechanism as in claim 1 further comprising a blocker arm on said cross head extending oppositely from said retractor arm into blocked relation with the tubular housing to maintain the retractor arm engaged in said radial window.

3. Deadlocking latch bolt mechanism as in claim 2, further comprising an opposite side wall on said tailpiece cam member, defining an opening in which said blocker arm is engaged, the engagement of said retractor and blocker arms in said window and opening of the side walls being operative to maintain the tailpiece cam member in alignment with the tailpiece for axial movement therewith.

4. Deadlocking latch bolt mechanism as in claim 2, further comprising a cavity in said latch bolt extending axially forward from its said skirt portion, and an end portion on one or both of said tailpiece and tailpiece cam member extending into guided relation with the walls of said cavity.

5. Deadlocking latch bolt mechanism as in claim 1 in which said tailpiece is in the form of a straight flat stamping, said deadlocking tumbler has a forward-extending deadlocking leg lying flat against one face of the tailpiece cross head, and said tailpiece cam member includes a bottom wall lying against the opposite face of the cross head with its windowed side wall extending across the plane of the cross head and into the plane of the tumbler leg.

6. Deadlocking latch bolt mechanism as in claim 5 in which said cam means comprises a cam face on said windowed side wall and a cam nose on the tumbler which is positioned for engagement by such cam face when the tumbler is in deadlocking position, retraction movement of the cam member by the tailpiece being operative to carry the cam face against such cam nose to move the tumbler to release position.

7. Deadlocking latch bolt mechanism as in claim 1 in which said cam means comprises a cam face on said windowed side wall and a cam nose on the tumbler which is positioned for engagement by such cam face when the tumbler is in deadlocking position, retraction movement of the cam member by the tailpiece being operative to carry the cam face against such cam nose to move the tumbler to release position.

8. Deadlocking latch bolt mechanism as in claim 1, further comprising bolt stop means for stoppin the latch bolt in forward projected position, tailpiece stop means for stopping forward movement of the tailpiece, there being limited lost motion between the latch bolt and tailpiece, and said stop means being operative to stop the tailpiece substantially at the rearward limit of its lost motion relative to the bolt so that retraction of the tailpiece is immediately effective to retract the bolt.

9. Deadlocking latch bolt mechanism as in claim 1, further comprising bolt stop means for stopping the bolt in forward projected position, there being limited lost motion of the retractor arm in the skirt window, tailpiece stop means for stopping the forward movement of the tailpiece in a position which disposes the retractor arm adjacent the rear of the skirt window, said deadlocking tumbler having a forward blocker nose which lies in blocking relation with a blocker face of the latch bolt with limited lost motion not substantially greater than that between the bolt and retractor arm so as to be taken by rearward thrust movement of the bolt into deadlocked engagement with said tumbler before such bolt movement causes rearward tailpiece movement sufficient to cause said cam means to move the tumbler to release position.

10. Deadlocking latch bolt mechanism as in claim 1, further comprising a back face on said latch bolt, said deadlocking tumbler having a blocker nose adapted to engage a blocker face on the bolt to deadlock the bolt, an auxiliary bolt slidably mounted along said back face, a guide arm carried by the auxiliary bolt and extending rearward therefrom, said side wall of the tailpiece cam member having an edge portion in guiding relation with said guide arm, and a release finger carried by said auxiliary bolt and extending into control relation with said blocker nose of the deadlocking tumbler so as to hold the tumbler in release position when the auxiliary bolt is in projected position.

11. Deadlocking latch bolt mechanism as in claim 5, further comprising a back face on said latch bolt, said deadlocking tumbler having a blocker nose adapted to engage a blocker face on the bolt to deadlock the bolt, an auxiliary bolt slidably mounted along said back face, a guide arm carried by the auxiliary bolt and extending rearward therefrom, said side wall of the tailpiece cam member having an edge portion in guiding relation with said guide arm, and a release finger carried by said auxiliary bolt and extending into control relation with said blocker nose of the deadlocking tumbler so as to hold tumbler in release position when the auxiliary bolt is in projected position.

12. Deadlocking latch bolt mechanism as in claim 1, further comprising a back face on the latch bolt, an auxiliary bolt slidably mounted along said back face, said cross head being a flat member lying parallel with said back face, with said retractor arm extending in one direction and a blocker arm extending in the other direction, said deadlocking tumbler having a forward deadlocking leg lying against one face of the cross head, said tailpiece cam member having a bottom wall parallel with the cross head at the face thereof opposite the tumbler leg, having its said side wall extending across the planes of the tailpiece and tumbler leg and having a guiding edge positioned parallel with the back face of the bolt, said auxiliary bolt carrying a guide arm in guided relation with said guiding edge and carrying a release finger extending into operative relation with the tumbler leg.

13. Latch bolt mechanism as in claim 1 with the addition of a guide block in the rear of the latch tube and guiding the tailpiece for axial movement therein, the tailpiece being biased forward by a spring acting between the latch bolt and such guide block, and means acting between the tailpiece and guide block to stop forward meovement of the tailpiece relative thereto.

14. Deadlocking latch bolt mechanism as in claim 1, further comprising a guide block in the housing defining a guideway for the tailpiece and a lateral restricted entranceway thereto, said tailpiece having a guidable portion complementary to said guideway and a narrower portion longitudinally displaced therefrom adapted to pass laterally through said entranceway to bring the guidable portion into alignment with the guideway.

15. Deadlocking latch bolt mechanism, comprising a tubular housing, a latch bolt slidable in the housing between projected and retracted positions, a deadlocking tumbler movable between deadlocking and release positions, an auxiliary bolt for controlling the position of the deadlocking tumbler, a tailpiece having forward means for connecting the same to retract the bolt and having rearward means for connection to retraction means, said mechanism also including the improvement comprising a guide block in the housing defining a guideway for the tailpiece and a lateral restricted entranceway to the guideway, said tailpiece having a guidable portion adapted to be guidingly retained in the guideway and a narrower portion longitudinally displaced therefrom adapted to pass laterally through said restricted entranceway to bring said guidable portion into alignment with said guideway.

16. Deadlocking latch bolt mechanism as in claim 15 with the addition of a stop on said tailpiece to limit forward guided movement of the tailpiece in the guide block.

17. Deadlocking latch bolt mechanism as in claim 15 in which the tailpiece guidable portion is of straight-sided bar shape, the tailpiece has a cross bar at the rear for connection to the retraction means, and the guide block is a generally circular block having an opening therein which defines the guideway centrally of the block and has an extended portion adapted to pas the guideable portion and cross bar therethrough in a pass-through position relative out of alitnment with the guideway, said narrowed tailpiece portion is forward of the guidable portion, and said entranceway is defined by side ribs in the opening between which the narrowed portion can move as the tailpiece is moved from such pass-through position to a position of alignment of its guidable portion with the guideway.

18. Deadlocking latch bolt mechanism as in claim 17 with the addition of a stop in the form of a boss upstanding from a side face of the tailpiece in position to engage the rear of the guide block to limit forward guided movement of the tailpiece in the guideblock, said tailpiece and boss being adapted to pass through said guideblock opening when the tailpiece is in said pass-through position.

19. Deadlocking latch bolt mechanism as in claim 17 in which said tailpiece has a cross head having at least one dimension larger than said guide block opening.

20. Deadlocking latch bolt mechanism as in claim 15 in which the tailpiece has a parallel-sided guidable portion, has a wider portion therebehind defining side shoulders for engagement behind the guide block to stop forward movement of the tailpiece, has a front cross head, and has its narrow portion between the cross head and guidable portion, and said guide block is of C-shaped cross section, defines the guideway between the end legs of the C and defines the entranceway as a laterally open gap between the in-turned ends of the C, and of a sufficient width to pass the narrow portion of the tailpiece.

21. Deadlocking latch bolt mechanism as in claim 15, further comprising a stop on said tailpiece for stopping the guide block with its guideway engaged with the guidable portion of the tailpiece so as to support the same in self-sustaining aligned, position at the rear of the tailpiece, the guide block being slidably received in the tubular housing, the tailpiece connection with the latch bolt being operable to support the latch bolt in substantially self-sustaining position at the front of the tailpiece, spring means for biasing the latch bolt to projected position and reacting against the guide block, whereby such parts can be preassembled in a substantially self-sustaining preassembly outside the latch tube and inserted as such therein.

22. Deadlocking latch bolt mechanism as in claim 21, further comprising a stop on said auxiliary bolt for stopping it against the latch bolt, and spring means for biasing the auxiliary bolt to projected position and reacting against said guide block, whereby the auxiliary bolt may be included in said preassembly.

23. Deadlocking latch bolt mechanism as in claim 22, further comprising a foot on said deadlocking tumbler seated against said guide block and biased thereaginst by one of said springs, whereby such tumbler may be included in said preassembly.

24. Latch bolt mechanism, comprising a tubular housing having an open end, a latch bolt slidable in the housing between projected and retracted positions, a tailpiece extending axially of the tubular housing and adapted to be drawn reaward to retract the bolt, the bolt being adapted to be assembled to the forward end of the tailpiece in self-sustaining and aligned forward-stopped position, a reaction member slidably receivable in the housing through its open end and means for mounting such member on a rearward portion of the tailpiece in self-sustaining and aligned rearward-stopped position, spring means for biasing the bolt forward and reacting against the reaction member, said bolt and reaction member being adapted to be assembled on the tailpiece and with other parts including the spring means to form a self-sustaining subassembly adapted to be inserted in the open end of the housing, and means for securing such subassembly in the housing, including forward stop means for stopping the bolt in projected position and rearward support means for supporting the reaction member in a rearward portion of the housing.

25. Latch bolt mechanism as in claim 23, further comprising a deadlocking tumbler supported against rearward axial movement by said reaction member, tumbler control means including an auxiliary bolt slidable along said latch bolt and stop means for stopping forward movement thereof relative to the latch bolt, and spring means for biasing the auxiliary bolt forward relative to the latch bolt, said tumbler, auxiliary bolt and spring means being adapted to be assembled in said self-sustaining subassembly for insertion therewith in the housing.

26. Latch bolt mechanism as in claim 24 in which the latch tube is open at the front end and includes a forwardly presented support at the rear for said reaction member.

27. Latch bolt mechanism as in claim 24 in which said reaction member is formed with a guideway for guiding the tailpiece for movement axially of the latch tube.

* * * * *

UNITED STATES PATENT AND TRADEMARK OFFICE

CERTIFICATE OF CORRECTION

PATENT NO. : 4,318,558

DATED : March 9, 1982

INVENTOR(S) : Walter E. Best et al

It is certified that error appears in the above-identified patent and that said Letters Patent is hereby corrected as shown below:

Column 7, lines 30 and 31, delete the sentence "To this end, the retractor arm 80 of the cross head 76."

Column 12, line 30 (claim 8), change "stoppin" to --stopping--.

Column 12, line 49 (claim 9), after "taken", insert --up--.

Column 13, line 10 (claim 11), after "hold", insert --the--.

Column 13, line 35 (claim 13), change "meovement" to --movement--.

Column 14, line 9, change "pas" to --pass-.

Column 14, line 11, change "alitnment" to --alignment--.

Signed and Sealed this

*Seventh* Day of *September 1982*

[SEAL]

*Attest:*

GERALD J. MOSSINGHOFF

*Attesting Officer*

*Commissioner of Patents and Trademarks*